US010028550B2

(12) United States Patent
Carbo, Jr. et al.

(10) Patent No.: US 10,028,550 B2
(45) Date of Patent: Jul. 24, 2018

(54) FOOTWEAR WITH REFLECTIVE OUTSOLE

(75) Inventors: Jorge E. Carbo, Jr., Aloha, OR (US); Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 933 days.

(21) Appl. No.: 13/544,524

(22) Filed: Jul. 9, 2012

(65) Prior Publication Data

US 2014/0007461 A1 Jan. 9, 2014

(51) Int. Cl.

*A43B 13/02* (2006.01)
*A43B 5/14* (2006.01)
*A43B 7/34* (2006.01)

(52) U.S. Cl.

CPC ..... *A43B 13/02* (2013.01); *A43B 5/14* (2013.01); *A43B 7/34* (2013.01); *A43B 13/026* (2013.01)

(58) Field of Classification Search

CPC ..... A43B 5/14; A43B 5/145; A43B 13/026; A43B 13/122
USPC ..... 36/103, 131, 137
See application file for complete search history.

(56) References Cited

U.S. PATENT DOCUMENTS 2,478,264 A 8/1949 George et al.
4,233,760 A * 11/1980 Haynes ..... 36/137
4,813,160 A 3/1989 Kuznetz
4,947,708 A * 8/1990 Lacombe ..... 74/594.6
5,220,791 A * 6/1993 Bulzomi ..... 36/3 R
5,406,723 A * 4/1995 Okajima ..... 36/131
5,611,156 A * 3/1997 Chiu ..... 36/137
6,101,636 A 8/2000 Williams
6,185,845 B1 * 2/2001 Gordon ..... A43B 1/00 36/2.6
6,312,782 B1 * 11/2001 Goldberg et al. ..... 428/67
6,477,793 B1 * 11/2002 Pruitt et al. ..... 36/131
6,564,475 B2 5/2003 Collins et al.
7,401,424 B2 * 7/2008 Kerns et al. ..... 36/131
7,452,833 B2 * 11/2008 Russell et al. ..... 442/378
7,681,333 B2 3/2010 Dardinski et al.
7,762,008 B1 7/2010 Clark et al.
7,814,687 B2 * 10/2010 Cook ..... A43B 1/0036 36/137
8,177,383 B2 * 5/2012 Reuben ..... 362/103
8,443,528 B2 * 5/2013 Kann ..... 36/7.2
8,613,149 B2 * 12/2013 Schwirian ..... 36/30 A
2001/0004808 A1 * 6/2001 Hurwitz ..... 36/137
2002/0078590 A1 * 6/2002 Collins et al. ..... 36/3 R
2004/0148809 A1 * 8/2004 Kikuta et al. ..... 36/131
2006/0130367 A1 * 6/2006 Liu ..... 36/55
2006/0254088 A1 * 11/2006 McCormick ..... 36/44
2008/0196277 A1 * 8/2008 Cook et al. ..... 36/137
2008/0271344 A1 * 11/2008 Skirrow ..... A43B 1/02 36/114

(Continued)

OTHER PUBLICATIONS

Advance HAWK Chrome Full Face Motorcycle Helmet, http://www.leatherup.com/p/Hawk-Helmets/Advance-HAWK-Chrome-Full-Face-Motorcycle-Helmet, Apr. 20, 2012, 4 pages.

(Continued)

*Primary Examiner* — Megan Lynch
(74) *Attorney, Agent, or Firm* — Klarquist Sparkman, LLP

(57) ABSTRACT

An article of footwear is provided and may include an upper and an outsole. The outsole may be formed from a rigid material and may include a heat-reflective coating opposing the ground during use.

21 Claims, 5 Drawing Sheets

(56) References Cited

U.S. PATENT DOCUMENTS

| | | | | |
|---|---|---|---|---|
| 2009/0007457 | A1* | 1/2009 | Skirrow | 36/133 |
| 2009/0049711 | A1* | 2/2009 | Finch | 36/7.6 |
| 2009/0188133 | A1* | 7/2009 | Munns | 36/131 |
| 2010/0031535 | A1* | 2/2010 | Leedy | 36/103 |
| 2010/0058509 | A1 | 3/2010 | Lambertz | |
| 2010/0122476 | A1* | 5/2010 | Le et al. | 36/30 R |
| 2010/0180474 | A1* | 7/2010 | Clark et al. | 36/3 B |
| 2010/0199520 | A1* | 8/2010 | Dua et al. | 36/87 |
| 2011/0107621 | A1* | 5/2011 | Mordecai et al. | 36/113 |
| 2011/0107622 | A1* | 5/2011 | Schwirian | 36/30 A |
| 2011/0167677 | A1* | 7/2011 | Peikert | A43B 1/04 36/3 B |
| 2012/0011750 | A1* | 1/2012 | Kann | 36/72 R |
| 2012/0023784 | A1* | 2/2012 | Goldston et al. | 36/137 |
| 2012/0066931 | A1* | 3/2012 | Dojan et al. | 36/83 |
| 2012/0090197 | A1* | 4/2012 | Wyner | A43B 1/0045 36/44 |
| 2012/0227282 | A1* | 9/2012 | Hawkinson et al. | 36/87 |
| 2013/0036628 | A1* | 2/2013 | Hussey et al. | 36/87 |
| 2013/0269217 | A1* | 10/2013 | Sussmann | 36/114 |
| 2014/0115922 | A1* | 5/2014 | Marvin et al. | 36/45 |

OTHER PUBLICATIONS

HardnutZ Auto Chrome Street Bike Helmet, http://www.halfords.com/webapp/wcs/stores/servlet, Apr. 19, 2012, 3 pages.

Cycle Helmets—Street, http://web.archive.org/web/20110205065006/http://www.hardnutz.com, Apr. 19, 2012, 3 pages.

IPS innovative products & systems, http://www.ips-innovations.com/solar_reflective_clothing.htm, Apr. 20, 2012, 3 pages.

Innovative insulation inc., www.radiantbarrier.com/temptrol.htm, Apr. 20, 2012, 6 pages.

Heat-Reflective Clothing—Grainger Industrial Supply, http://www.grainger.com/Grainger/ecatalog/N-1Z0ccv7, Apr. 20, 2012, 4 pages.

* cited by examiner

FOOTWEAR WITH REFLECTIVE OUTSOLE

FIELD

The present disclosure relates to an article of footwear and more particularly to an article of footwear having a reflective outsole.

BACKGROUND

This section provides background information related to the present disclosure which is not necessarily prior art.

Endurance sports such as triathlons, marathons, and cycling are becoming increasingly popular both as competitive sports and as recreational activities for novice athletes. Such endurance sports are often conducted year-round and in different climates, thereby requiring participants to perform in unfavorable and challenging environments. For example, triathlons are generally conducted regardless of the weather and therefore often subject athletes to extreme temperatures and/or wet conditions. As a result, the performance of the athlete is compromised with energy that could otherwise be directed to the particular physical activity (i.e., running, biking, or swimming) being spent cooling or heating the athlete's body.

Cycling and running, in particular, present a unique challenge to an endurance athlete in hot-weather conditions. Namely, not only must the athlete contend with ambient-air conditions during the event, cycling and running come with the additional challenge of dealing with heat generated by infrared (IR) radiation caused by heat reflecting off of the ground and other surroundings back at the athlete. The ambient-air temperature coupled with the heat radiated from the ground and other surroundings increases the body temperature of the athlete and, as a result, negatively impacts the athlete's ability to optimally perform.

SUMMARY

This section provides a general summary of the disclosure, and is not a comprehensive disclosure of its full scope or all of its features.

An article of footwear is provided and may include an upper and an outsole. The outsole may be formed from a rigid material and may include a heat-reflective coating opposing the ground during use.

In another configuration, an article of footwear is provided and may include an upper and an outsole. The outsole may include a heat-reflective coating and a cleat, whereby the cleat selectively attaches the outsole to an external structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
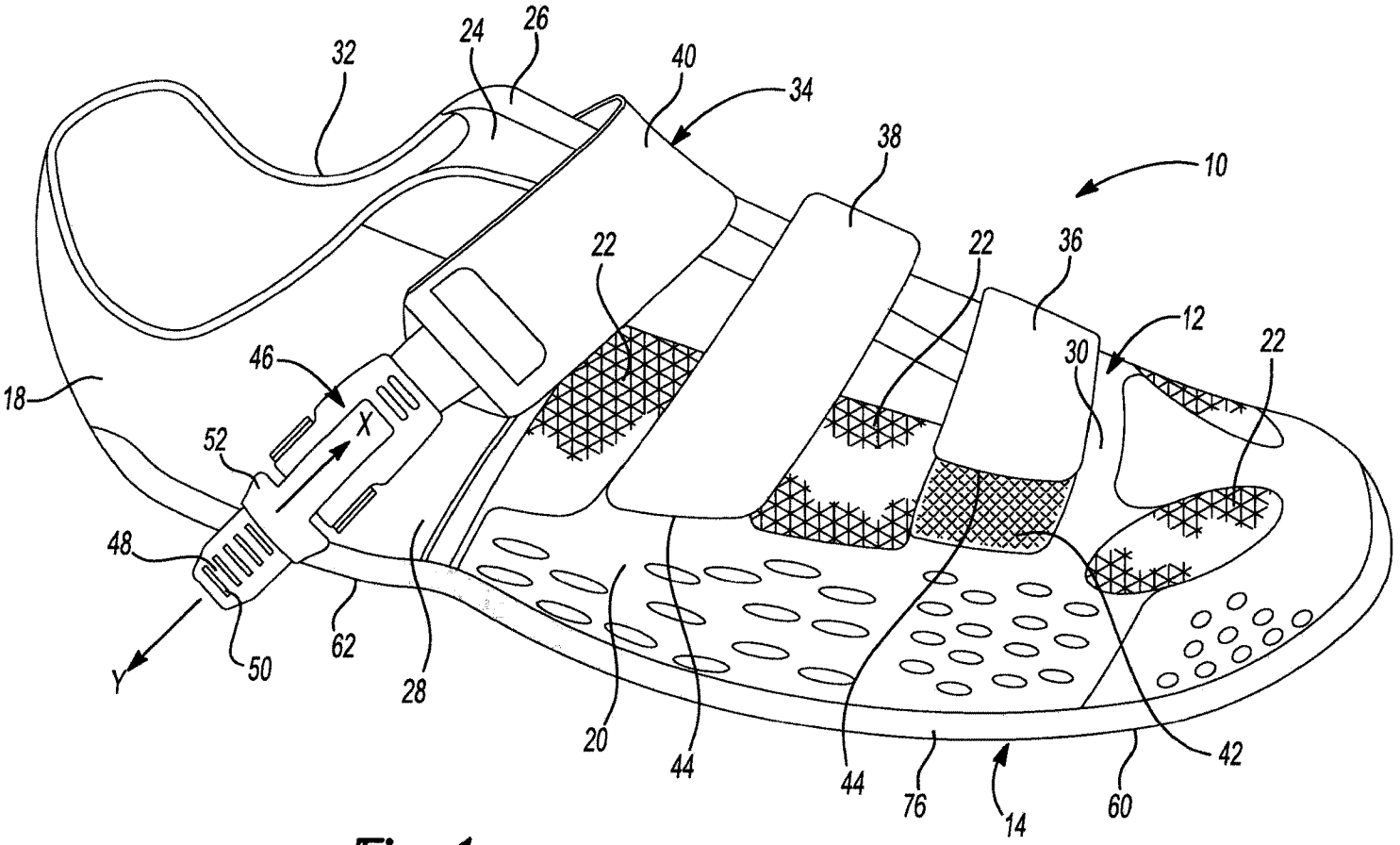
FIG. 1 is a perspective view of an article of footwear in accordance with the principles of the present disclosure.
Figure 2:
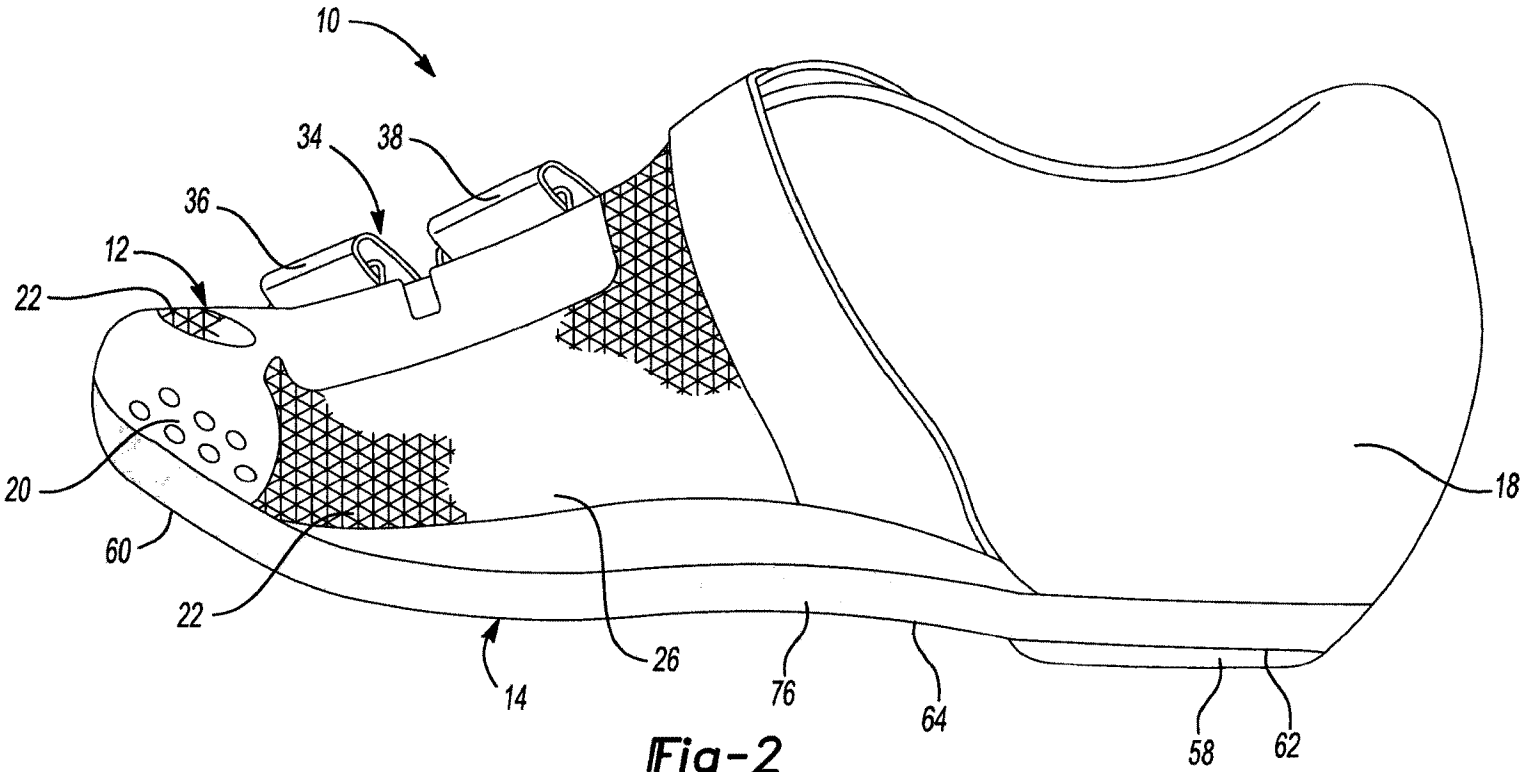
FIG. 2 is a perspective view of an article of footwear in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 5:
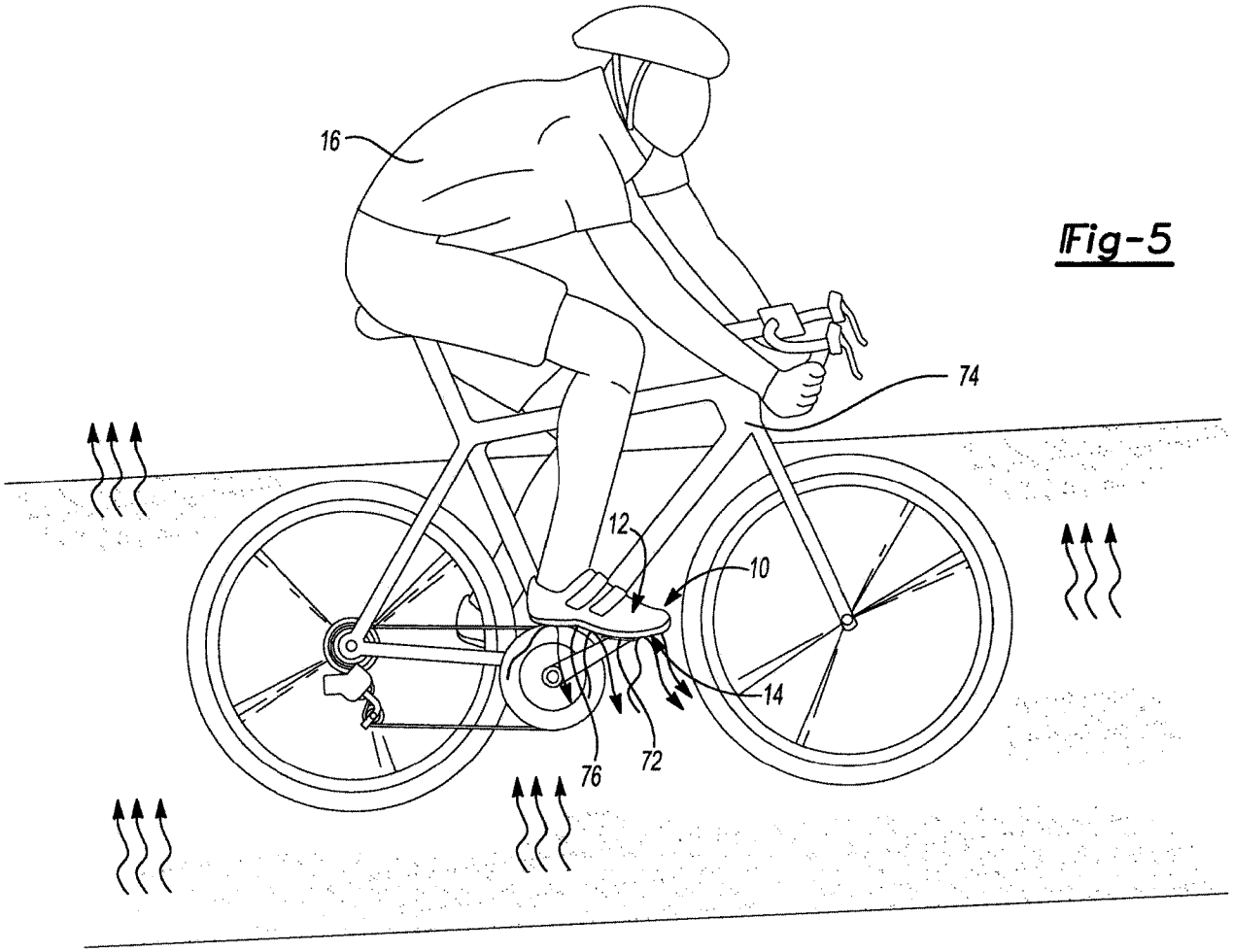
FIG. 5 is a perspective view of the article of footwear of FIG. 1 being used in conjunction with a bicycle to schematically represent the article of footwear reflecting heat away from a cyclist.

With reference to the figures, an article of footwear 10 is provided and may include an upper 12 and an outsole 14. The upper 12 cooperates with the outsole 14 to support the foot of a user 16 (FIG. 5) during an activity such as, for example, cycling.

The upper 12 may be formed from any combination of materials that provide the upper 12 with flexibility and breathability while concurrently providing support to a foot. For example, the upper 12 may include a leather portion 18, a plastic portion 20, and a series of nylon-mesh portions 22 that cooperate to provide support to a foot while concurrently allowing airflow into and out of the upper 12.

The upper 12 may additionally include a tongue 24 disposed between a medial portion 26 and a lateral portion 28. The tongue 24 may be attached to one or both of the medial portion 26 and the lateral portion 28 and may extend generally between a toe portion 30 and a collar portion 32 of the upper 12.

A fastening system 34 may extend between the medial portion 26 and the lateral portion 28 to selectively draw the medial portion 26 and lateral portion 28 closer to one another. In so doing, the fastening system 34 may secure a foot within the upper portion to reduce relative movement between the foot and the upper 12. The fastening system 34 may include a first strap 36 located proximate to the toe portion 30, a second strap 38 located adjacent to the first strap 36, and a third strap 40 located proximate to the collar portion 32. As described, the first strap 36 may be located proximate to the toe portion 30, the third strap 40 may be located proximate to the collar portion 32, and the second strap 38 may be located between the first strap 36 and the third strap 40 such that the second strap 38 spans a mid-foot portion of the upper 12.

The first strap 36 and the second strap 38 may include a hook-and-loop fastener 42 that provides for selective adjustment of the first strap 36 and the second strap 38 relative to the upper 12. For example, a distal end 44 of the first strap 36 and second strap 36 may be moved closer to or farther away from the lateral portion 28 of the upper 12 to adjust the fit of the upper 12 about a foot.

In operation, a force may be applied to the first strap 36 and/or to the second strap 38 to adjust a position of the distal end 44 of each strap 36, 38 relative to the lateral portion 28. Moving the distal end 44 of each strap 36, 38 closer to the lateral portion 28 causes the upper 12 to more closely surround a foot and, as a result, tightly secures the foot within the upper 12. Conversely, moving the distal end 44 of each strap 36, 38 farther away from the lateral portion 28 allows for a greater separation between the medial portion 26 and the lateral portion 28, thereby loosening the upper 12 to allow additional movement between a foot and the upper 12 and/or to accommodate a foot having a relatively large width. In any event, once a desired adjustment of each strap 36, 38 is achieved, the hook-and-loop fastener 42 of each strap 36, 38 retains a desired position of the distal end 44 of each strap 36, 38 relative to the lateral portion 28.

The third strap 40 may include a locking mechanism 46 that may be used to adjust the relative position between the medial portion 26 and the lateral portion 28 at the collar portion 32 to thereby adjust the fit of the upper 12 about a foot. The locking mechanism 46 may slidably receive a projection 48 of the third strap 40 and may selectively fix a position of the projection 48 and, thus, a position of the third strap 40 relative to the upper 12.

In one configuration, the locking mechanism 46 is fixed for movement with the upper 12 and is movable between a locked state (FIG. 1) and an unlocked state (not shown). The locking mechanism 46 may slidably receive the projection 48 when in the locked state and may allow the projection 48 to ratchet within the locking mechanism 46 until a desired position of the projection 48 and, thus, the third strap 40 relative to the upper 12 is achieved. Specifically, the projection 48 may include a series of slots 50 (FIG. 1) that are received by the locking mechanism 46 as the projection 48 passes through the locking mechanism 46. The slots 50 may cooperate with the locking mechanism 46 to prevent movement of the projection 48 in the (X) direction (FIG. 1) to fix a position of the projection 48 and the third strap 40 relative to the upper 12.

Movement of the projection 48 and, thus, the third strap 40 in the (X) direction may only be achieved when the locking mechanism 46 is moved from the locked state to the unlocked state. Such movement may be accomplished by applying a rotational force on a release lever 52 of the locking mechanism 46 to permit the slots 50 to disengage the locking mechanism 46, thereby allowing movement of the projection 48 and third strap 40 in the (X) direction.

In operation, a force may be applied to the projection 48 to cause the projection 48 to move relative to the locking mechanism 46 such that the projection 48 moves in the (Y) direction (FIG. 1). The projection 48 may ratchet along the locking mechanism 46, as the projection 48 engages adjacent slots 50 until a desired position of the projection 48 and third strap 40 relative to the upper 12 is achieved. At this point, the relative position of the projection 48 and the third strap 40 relative to the upper 12 is maintained due to interaction between the slots 50 of the projection 48 and the locking mechanism 46. Again, a force may be applied to the release lever 52 to permit movement of the projection 48 and, thus, the third strap 40, in the (X) direction to reduce the force exerted on a foot by the third strap 40 and/or to remove a foot from the upper 12.

In short, movement of the projection 48 in the (Y) direction causes the medial portion 26 and the lateral portion 28 to move closer to one another and, as a result, causes a greater force to be applied on a foot disposed within the upper 12 to snuggly secure the foot within the upper 12. Conversely, moving the projection 48 in the (X) direction increases the separation between the medial portion 26 and the lateral portion 28, thereby reducing the force applied on a foot disposed within the upper 12 to permit relative movement between the foot and the upper 12 and/or to accommodate a larger foot.

Figure 3:
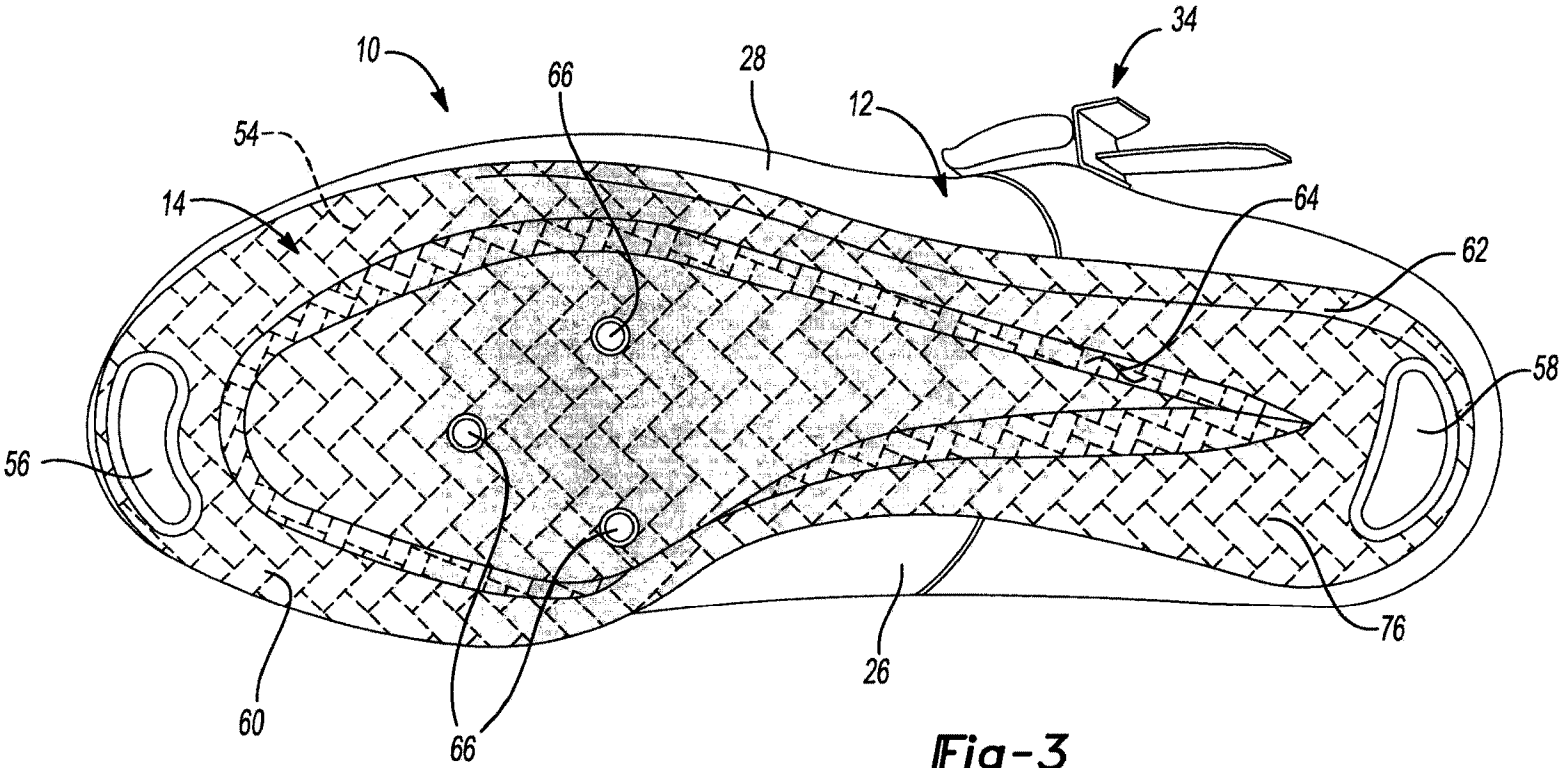
FIG. 3 is a bottom view of the article of footwear of FIG. 1.
Figure 4:
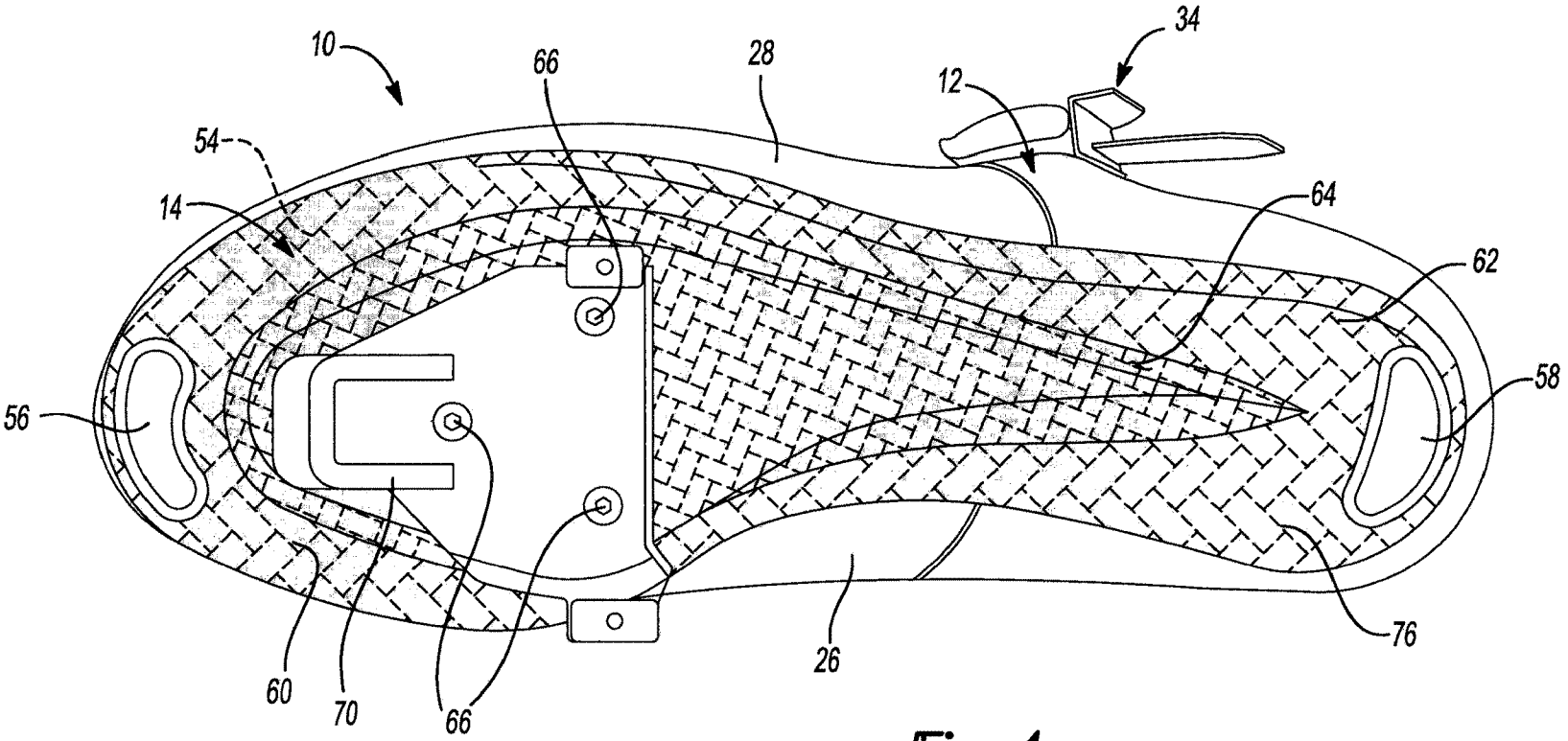
FIG. 4 is a bottom view of the article of footwear of FIG. 1 incorporating a cleat.

The outsole 14 may be fixedly attached to the upper 12 and may be formed from a semi-rigid or rigid material to provide support to a foot during use. In one configuration, the outsole 14 may be formed from carbon fiber (schematically represented by reference number (54) in FIGS. 3 and 4) and may extend along an entire length of the outsole 14. Forming the outsole 14 from carbon fiber provides the outsole 14 with rigidity and, further, allows the outsole 14 to be custom fit to a particular user's foot.

The outsole 14 may additionally include a toe grip 56 and a heel grip 58. The toe grip 56 may be located proximate to a toe portion 60 of the outsole 14 while the heel grip 58 may be located proximate to a heel portion 62 of the outsole 14. The toe grip 56 and the heel grip 58 may be formed from a material that enhances traction between the outsole 14 and the ground. For example, the toe grip 56 and the heel grip 58 may be formed from an elastomeric material such as, for example, rubber, to locally increase friction between the outsole 14 at the toe grip 56 and at the heel grip 58. Further, the toe grip 56 and the heel grip 58 may protrude from an outer surface 64 of the outsole 14 to maintain separation between the outer surface 64 and the ground.

The outsole 14 may additionally include a series of apertures 66 (FIG. 3) that selectively and threadably receive fasteners 68. The fasteners 68 may be used to secure a clip 70 to the outsole 14 such that the clip 70 is fixed for movement with the outsole 14. The clip 70 may be used to selectively attach the outsole 14 and, thus, the article of footwear 10, to a pedal 72 (FIG. 5) of a bicycle 74. Securing the article of footwear 10 to the pedal 72 increases the cycling efficiency of the user 16, thereby improving the overall performance of the user 16.

The outsole 14 may also include a coating 76 that spans the entire outsole 14. The coating 76 may be a reflective coating that reduces the penetration of infrared (IR) radiation through the outsole 14. Specifically, the coating 76 may be formed from a highly reflective material that reduces penetration of IR radiation through the carbon fiber of the outsole 14 and, thus, reflects heat away from a foot when disposed within the upper 12.

In one configuration, the coating 76 may be applied to the carbon fiber 54 via a hydrographics process or via a water-transfer printing process that transfers a reflective sheet onto the carbon fiber 54. The sheet may be formed from metalized thermoplastic polyurethane (TPU), for example, that is applied to the carbon fiber 54 to provide the outsole 14 with reflective properties and a reflective appearance. While the coating 76 is described as being applied via a TPU coating, a reflective paint could alternatively be applied to the carbon fiber 54 to provide the outsole 14 with reflective properties and a reflective appearance. For example, the coating 76 may be applied to the carbon fiber 54 via a vapor-deposition process or via a sputtering process, whereby a metalized layer is applied to the carbon fiber 54 using a material that doesn't oxidize in air.

The reflective coating 76 may extend across the entire carbon fiber outsole 14 and may surround the toe grip 56, the heel grip 58, and the apertures 66. As such, when the clip 70 is attached to the outsole 14 via the apertures 66 and the fasteners 68, the clip 70 may likewise be surrounded by the heat-reflective coating 76.

The heat-reflective coating 76 may be applied to the outsole 14 such that a portion of the coating 76 extends continuously from the outsole 14 onto a portion of the upper 12. As such, the coating 76 may extend over a joint between the upper 12 and the outsole 14 to provide the upper 12 with heat-reflective properties as well.

In operation, the clip 70 may be attached to the pedal 72 to couple the article of footwear 10—via the outsole 14—to the pedal 72. As such, the outsole 14 and, thus, the heat-reflective coating 76, opposes the ground during use. Furthermore, because the outsole 14 is fixed for movement with the pedal 72 when the clip 70 is attached to the pedal 72, the outer surface 64 of the outsole 14 and, thus, the heat-reflective coating 76, are spaced apart and separated from the ground during use. In short, the heat-reflective coating 76 applied to the outer surface 64 of the outsole 14 opposes and is spaced apart and separated from the ground during use.

Because the heat-reflective coating 76 opposes the ground during use, heat in the form of IR radiation radiated toward the article of footwear 10 is reflected off of the coating 76 and is directed back toward the ground. In so doing, the IR radiation is reflected away from the carbon fiber 54 of the outsole 14, thereby reducing the radiative heat load experienced by the outsole 14 caused by the IR radiation emanating from the ground as the bicycle 74 is propelled.

Applying the heat-reflective coating 76 to the joint between the upper 12 and the outsole 14 and, further, allowing the heat-reflective coating 76 to extend onto the upper 12, likewise inhibits the IR radiation from passing into the article of footwear 10 as the article of footwear 10 is cycled through a range of motion caused by pedaling. Again, preventing the IR radiation from penetrating the upper 12 and the outsole 14 restricts the absorption of IR radiation that would cause a rise in temperature of the user's foot while cycling.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear having a medial portion, a lateral portion, a forefoot portion, and a heel portion, the article of footwear configured to be worn on a foot, the article of footwear comprising:

an upper that defines a cavity configured for receiving the foot; and an outsole formed from a rigid material, the outsole attached to the upper, the outsole including a ground-opposing surface having an outer periphery, the outer periphery extending along the medial portion, across the forefoot portion, along the lateral portion, across the heel portion, and back to the medial portion, the ground-opposing surface configured to span underneath the foot when worn;

a heat-reflective coating on the ground-opposing surface of the outsole, the heat-reflective coating defining an exterior surface of the article of footwear; and a grip structure that protrudes from the ground-opposing surface and the exterior surface, the grip structure being encompassed by the outer periphery and being spaced apart from the outer periphery, the grip structure configured to maintain separation between the exterior surface and a ground surface;

wherein the exterior surface spans between the medial portion, the lateral portion, the forefoot portion, and the heel portion and is configured to be disposed underneath the foot;

wherein the exterior surface defined by the heat-reflective coating is configured to oppose the ground during use and to reflect heat from the ground;

wherein the heat-reflective coating surrounds the grip structure; and wherein the heat-reflective coating is absent from the grip structure.

2. The article of footwear of claim 1, wherein the outsole includes an upper surface that faces the upper, wherein the ground-opposing surface faces away from the upper surface, and wherein said heat-reflective coating coats and extends over an entirety of said ground-opposing surface of said outsole member.

3. The article of footwear of claim 1, further comprising a joint between the upper and the outsole, and wherein said heat-reflective coating includes a portion that extends continuously from said outsole, over said joint, and onto said upper.

4. The article of footwear of claim 3, wherein said portion of heat-reflective coating extends continuously from said outsole, over said joint, and onto said upper proximate to the forefoot portion.

5. The article of footwear of claim 1, wherein said heat-reflective coating is formed from metallized thermoplastic material.

6. The article of footwear of claim 1, further comprising a cleat attached to said outsole, said cleat projecting from said ground-opposing surface and said exterior surface away from said upper, said cleat covering a portion of said heat-reflective coating and said outsole and operable to selectively attach said outsole to an external structure.

7. The article of footwear of claim 6, wherein said external structure is a pedal.

8. The article of footwear of claim 1, wherein the outsole includes a carbon fiber, wherein said heat-reflective coating is layered over said carbon fiber to increase the reflectance of infrared radiation away from said carbon fiber during use.

9. The article of footwear of claim 1, wherein said heat-reflective coating is a film that is layered over and affixed to the ground-opposing surface of the outsole.

10. The article of footwear of claim 9, wherein said heat-reflective coating is a thermoplastic polyurethane (TPU) film that is layered over the ground-opposing surface of the outsole.

11. An article of footwear having a medial portion, a lateral portion, a forefoot portion, and a heel portion, the article of footwear configured to be worn on a foot, the article of footwear comprising:

an upper that defines a cavity configured for receiving the foot; and an outsole attached to the upper, the outsole formed of a rigid material and including a ground-opposing surface, the ground-opposing surface having an outer periphery, the outer periphery extending along the medial portion, across the forefoot portion, along the lateral portion, across the heel portion, and back to the medial portion, the ground-opposing surface configured to span underneath the foot when worn;

a heat-reflective coating that is coated on the ground-opposing surface of the outsole to at least partially define an exterior surface of the article of footwear; and an aperture that extends through the heat-reflective coating and into the outsole, the aperture configured for removably attaching a cleat to the outsole, the heat-reflective coating surrounding the aperture, the aperture being spaced apart from the outer periphery;

wherein the exterior surface is configured to extend underneath the foot, the heat-reflective coating configured to oppose the ground during use and to reflect heat from the ground.

12. The article of footwear of claim 11, wherein said outsole is formed from carbon fiber.

13. The article of footwear of claim 11, wherein said heat-reflective coating is formed of metallized thermoplastic material.

14. The article of footwear of claim 11, wherein said aperture is disposed proximate said forefoot portion.

15. The article of footwear of claim 11, further comprising the cleat that attached to said outsole, said cleat projecting from said ground-opposing surface and said exterior surface away from said upper, said cleat covering a portion of said heat-reflective coating and operable to selectively attach said outsole to an external structure;

wherein the heat-reflective coating surrounds the cleat; and wherein the heat-reflective coating is absent from the cleat.

16. The article of footwear of claim 11, further comprising a joint between the upper and the outsole, and wherein said heat-reflective coating includes a portion that extends continuously from said outsole, over said joint, and onto said upper.

17. The article of footwear of claim 16, wherein said portion of heat-reflective coating extends continuously from said outsole, over said joint, and onto said upper proximate to the forefoot portion.

18. The article of footwear of claim 11, wherein said heat-reflective coating is formed from a material operable to increase the reflectance of infrared radiation away from said outsole.

19. The article of footwear of claim 15, wherein said external structure is a pedal.

20. The article of footwear of claim 11, wherein the outsole includes an upper surface that faces the upper, wherein the ground-opposing surface faces away from the upper surface;

wherein said heat-reflective coating is a film that covers an entirety of the ground-opposing surface; and wherein said heat-reflective coating extends between the medial portion, the lateral portion, the forefoot portion, and the heel portion.

21. An article of footwear having a medial portion, a lateral portion, a forefoot portion, and a heel portion, the article of footwear configured to be worn on a foot, the article of footwear comprising:

an upper that defines a cavity configured for receiving the foot; and an outsole attached to the upper, the outsole formed of a rigid material and including a ground-opposing surface, the ground-opposing surface having an outer periphery, the outer periphery extending along the medial portion, across the forefoot portion, along the lateral portion, across the heel portion, and back to the medial portion, the ground-opposing surface configured to span underneath the foot when worn;

a heat-reflective coating on the ground-opposing surface of the outsole, the heat-reflective coating defining an exterior surface of the article of footwear; and an aperture that extends through the heat-reflective coating and into the outsole, the aperture configured for removably attaching a cleat to the outsole, the heat-reflective coating surrounding the aperture, the aperture being spaced apart from the outer periphery;

wherein the exterior surface is configured to extend underneath the foot, the heat-reflective coating configured to oppose the ground during use and to reflect heat from the ground; and wherein a joint is defined between the upper and the outsole, and wherein the heat-reflective coating includes a portion that extends continuously from the outsole, over the joint, and onto the upper.

* * * * *